US005869934A

United States Patent [19]

Goff

[11] Patent Number: 5,869,934

[45] Date of Patent: Feb. 9, 1999

[54] BARRICADE LIGHT CONTROL SWITCH APPARATUS

[75] Inventor: LeRoy L. Goff, Villa Park, Ill.

[73] Assignee: WLI Industries Inc., Villa Park, Ill.

[21] Appl. No.: 777,353

[22] Filed: Dec. 27, 1996

[51] Int. Cl.[6] ..... H01H 9/00

[52] U.S. Cl. ..... 315/200 A; 340/547; 340/471; 340/908.1; 340/480; 335/193; 315/33

[58] Field of Search ..... 362/264, 72; 340/463, 340/480, 471, 33, 547, 908.1; 315/241 S, 200 A; 335/193, 202, 173

[56] References Cited

U.S. PATENT DOCUMENTS 3,696,380 10/1972 Murphy .
4,782,432 11/1988 Coffman ..... 362/184

*Primary Examiner*—Robert Pascal
*Assistant Examiner*—Arnold Kinkead
*Attorney, Agent, or Firm*—Dick and Harris

[57] ABSTRACT

The present invention is directed to a barricade light control switch apparatus for operating a battery powered barricade light unit. The apparatus comprises a light unit housing, light source, battery, and circuit means for controlling operation of the light source, and a reed switch. A magnet retained by a magnet carrier is positionable in either of two positions and controls operation of the reed switch. When the magnet carrier is in a first position the magnet is positioned in proximity to and closes the reed switch. When the magnet carrier is in a second position the magnet is positioned away from and opens the reed switch. Retention means preclude unintended movement of the magnet carrier. A method for controlling a barricade light unit is also disclosed.

9 Claims, 3 Drawing Sheets

BARRICADE LIGHT CONTROL SWITCH APPARATUS

BACKGROUND OF THE INVENTION

1. Field of the Invention

This invention relates to battery operated light units typically situated atop barricades placed along the road-side to mark constructions zones or otherwise warning passing motorists. More particularly, the invention pertains to a light control switch apparatus which controls the barricade mounted light unit and which is constructed and operates in a manner which minimizes breakdown obviating repair thus reducing the cost of operation.

2. Background of the Invention

Barricade mounted light units are required to be used in virtually every road construction project in order to warn and alert motorists generally to the presence of the construction zone and particularly to the presence and location of a specific hazard. A typical barricade mounted light unit is configured to operate in either a steady burn mode or in a flashing mode. The typical highway project requires the use of many illuminated barricades which represent a significant expense regardless of whether they are purchased by the construction company, provided by a municipal entity or rented from a barricade provider.

In any event, the cost associated with providing and using illuminated barricades must take into account both the outright damage sustained by the barricades when in use as well as mere wear and tear. Specifically, in addition to the cost of performing what are often significant repairs required to correct the damage incurred when barricades are struck, however inadvertently, by passing automobiles and trucks, ongoing the maintenance and repair associated with the light unit itself is also of significant concern.

Typically, a switch is provided to control operation of the light unit and specifically select between a steady burn mode in which the light source is substantially continually illuminated, and a flashing mode in which the light source is observed to be alternatively on and off. To date, virtually every lighting unit has relied upon a simple low-cost mechanical switch which serves to make or break a contact in an electrical circuit via a mechanical, moveable member.

Other than in cases of collision damage, it has been found that a significant number of illuminated barricades which are removed from service for failure of the light unit to properly operate require repairs to the mechanical switch. The light unit is of course used out-doors and is continually subjected to the weather for extended periods of time. The mechanical switch appears to be unable to reliably withstand the riggers of the elements over long periods of time as rain, snow and other harsh conditions often serve to cause corrosion of the switch contacts which may, in turn, cause the switch to remain permanently in either one or the other of its positions. If the switch is not repaired a potential liability may exist if mandated lighting regulations are not adhered to.

The typical road-side barricade is illuminated with either an incandescent or LED based light source which, of course, due to portability is in virtually every case, battery powered. An additional expense attributed to the operation of illuminated road-side barricades are the batteries themselves, which of course must be periodically replaced. Thus, a second switch may, in some cases, be provided in order to preclude the light from being continually on thus conserving battery life, many prior art illuminated barricades incorporate a photo cell which serves to turn on the light only upon detecting darkness. However, since a photo cell based illuminated barricade will continue to illuminate the light unit whenever dark, and even when the barricade is not in active use as when in storage off the construction site, a dedicated on/off switch may totally disable the light unit. Accordingly, if an on/off switch is provided, premature battery replacement will be required if a defective on-off switch is not repaired.

Accordingly, it is an object of the invention to provide for a lighting control which is not susceptible to damage inflicted by environmental conditions and the like.

In addition to the simple mechanical switch arrangement used by conventional prior art barricade light units, a further prior art light control mechanism is disclosed in U.S. Pat. No. 5,469,157 granted to Carpenter et al. on Nov. 21, 1995, which relates to a barricade light with light emitting diode. As disclosed, contained within the light emitting diode assembly retrofitted to conventional barricade light is a printed circuit board mounted pulse activated switch which is activated externally through the use of a hand-held control unit. The electronic switch mechanism comprises at least, in part, an integrated circuit and two on-board copper input plates. Activation of the hand held device generates an electronic pulse which is received by one of the input plates. As disclosed, the hand held actuator must be positioned extremely close to the light unit, usually within five centimeters, in order to turn the light on or off.

While preventing the unintended operation of the light units, one potential limitation and disadvantage of this prior art device is the necessity for the operator to have possession of a working hand-held actuator to operate the switch. The light units cannot be operated if the actuator is broken or if it is forgotten or lost by the operator. Further, the complexity of the circuitry required by this prior art apparatus and the potential need to possess multiple actuators and repair and replace same most certainly adds to the cost of the barricades.

Accordingly, it is an object of the invention to provide a light unit control switch which is reliable, durable, inexpensive and minimizes the need for repair.

These and other objects of the present invention will become apparent in light of the present specification, claims, and drawings.

SUMMARY OF THE INVENTION

The present invention comprises a barricade light control switch apparatus for operating a battery powered barricade light unit including a light unit housing, a light source, and a battery electrically connected to the light source for supplying electrical energy to operate the light source. Circuit means are provided for controlling operation of the light source and include a reed switch the position of which controls the operation of the light source. A magnet is alternatively positioned in proximity to and away from the reed switch to, in turn, operate said reed switch. In the preferred embodiment of the invention, the barricade light control switch apparatus further includes a magnet carrier for retaining the magnet. The said magnet carrier is positionable in a first position and in a second position whereby the magnet is positioned in proximity to said reed switch when the magnet carrier is in its first position and whereby the magnet is positioned away from the reed switch when the magnet carrier is in its second position.

In one embodiment of the invention the light unit housing of the barricade light control switch apparatus includes an aperture formed therein for permitting access to the magnet carrier. A tool or pin may thus be inserted through the aperture which is formed in alignment with the magnet carrier to, in turn, permit moving the magnet carrier alternatively between the first position and the second position. The barricade light control switch apparatus further includes retention means operably associated with the magnet carrier for precluding unintended movement of the magnet carrier within said light unit housing, to in turn, maintain said magnet in either of the first position or the second position relative to the reed switch.

In one embodiment of the invention the circuit means serves to selectively cause the light source to remain substantially and continually illuminated or cause the light source to periodically illuminated in a flashing mode as dictated by the position of the reed switch which is controlled by the position of the magnet which is retained within the magnet carrier.

The present invention further comprises a method for controlling a barricade mounted light unit which light unit includes a light source, a battery for supplying electrical energy to the light source, a reed switch for controlling operation of said light source, and a magnet for actuating said reed switch. The method specifically comprises the steps of positioning said magnet in a first position relative to said reed switch closing said reed switch and thereby permitting operation of said light unit in a first mode; maintaining the magnet in the first position for such period of time as it is desired that the light unit operate in the first mode, whereby the magnet serves to maintain the reed switch in a closed position even in the presence of external vibration and forces which might otherwise serve to open said reed switch; and alternatively positioning the magnet in a second position relative to the reed switch thereby permitting operation of the light unit in a second mode.

In another embodiment of the invention the method comprises the steps of positioning the magnet in a first position relative to said reed switch to close the reed switch to thereby permit the connection of said battery to said light source to in turn permit operation of the light unit; maintaining the magnet in said first position for such period of time as it is desired that the light unit be operable, such that the magnet serves to maintain said reed switch closed in the presence of external vibration and forces which might otherwise serve to open the reed switch and render said light unit inoperable; and positioning the magnet in a second position relative to the reed switch to open the reed switch to thereby disconnect the battery from said light source to in turn preclude operation of the light unit.

DETAILED DESCRIPTION OF THE DRAWINGS

Figure 1:
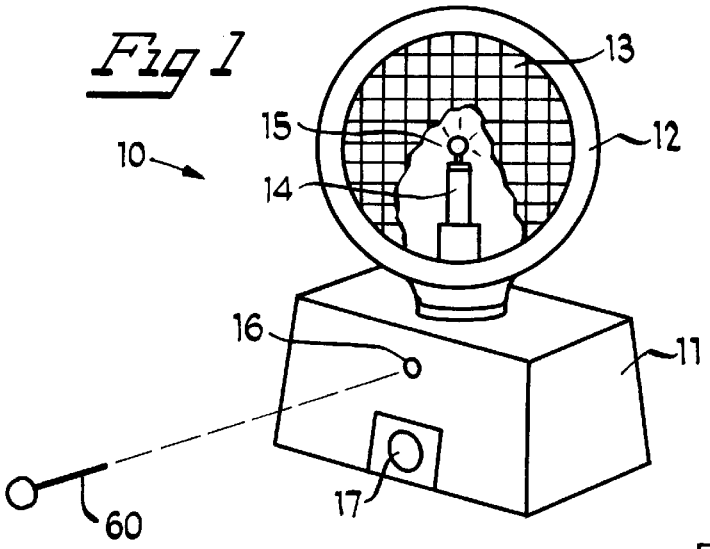
FIG. 1 of the drawings is a perspective view of a barricade mountable light unit incorporating the present invention.

While the invention is susceptible of embodiment in many different forms, there is shown in the drawings and herein will be described in detail, one specific embodiment with the understanding that the present disclosure is to be considered as an exemplification of the principals of the invention and is not intended to limit the invention to the embodiment illustrated.

FIG. 1 of the drawings is a perspective view of the barricade mountable light unit 10 incorporating the barricade light control switch apparatus comprising the present invention. Barricade light unit 10 comprises a base 11 containing the batteries for operating the light (not shown) as well as the electronic circuitry and present barricade light control switch apparatus. Access to the switch apparatus is obtained through access port 16 as further described herein. Light source 15, which typically comprises either one or more incandescent lamps or light emitting diodes, is shown situated atop hollow light source holder or "candle" 14 which emanates from base 11 and serves to retain the light source and provides a passage for connecting electrical wiring from the batteries and circuit to the light source 15. Lens assembly 12 incorporating lens 13 is shown positioned atop of base 11 and is constructed in a known manner. Bolt aperture 17 is shown extending through base 11 serves to provide means for affixing the barricade light unit to a typically "saw-horse" or other form of barricade.

Figure 2:
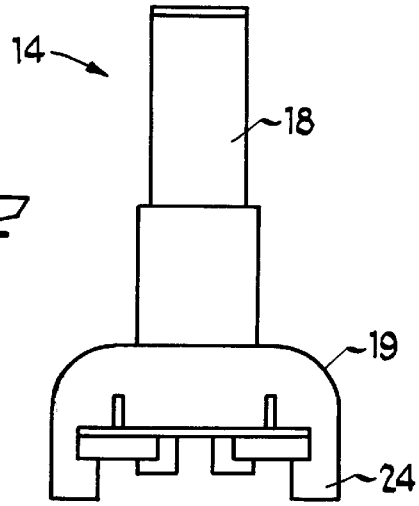
FIG. 2 of the drawings is a front elevational view of the light source holder incorporating the slide switch apparatus of the present invention.

FIG. 2 of the drawings illustrates a front elevational view of hollow tubular candle 14 specifically showing upper portion 18 and base portion 19. In an assembled configuration, tubular candle 14 rests on the batteries operating the light unit via battery contacts not shown. The upper portion of tubular candle 14 is provided with a holding collar 18*a* which is configured for retaining the light source such as a conventional incandescent lightbulb or LED array. As the upper portion 18 of tubular candle 14 is hollow it also serves to accommodate in its interior space the wiring required for conducting electrical energy from the battery to the light source.

Figure 3:
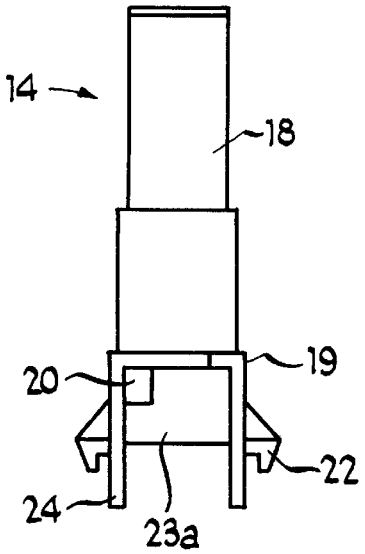
FIG. 3 of the drawings is a right side elevational view of the light source holder incorporating the slide switch apparatus of the present invention.
Figure 4:
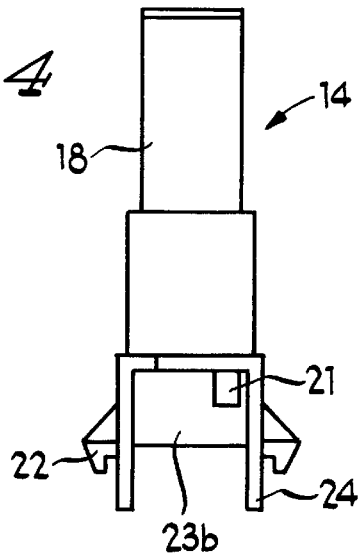
FIG. 4 of the drawings is a left side elevational view of the light source holder incorporating the slide switch apparatus of the present invention.
Figure 5:
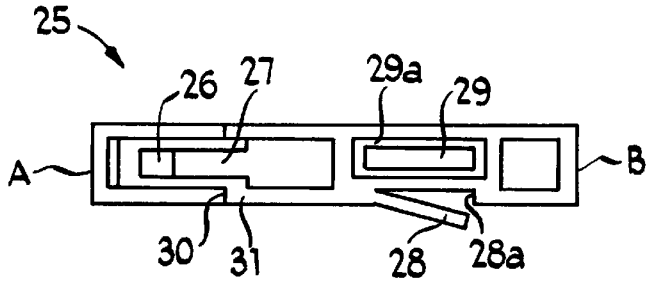
FIG. 5 of the drawings is a top plan view of the slide switch of the present invention.
Figure 6:
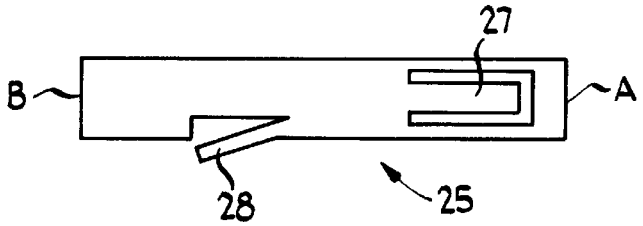
FIG. 6 of the drawings is a bottom plan view of the slide switch of the present invention.

Further details of the construction of tubular candle 14 are evident from the side elevational views thereof illustrated FIG. 3 and FIG. 4. As can be seen, base portion 19 of tubular candle 14 further comprises side panels 24, flange portions 22 and end panels 23*a* and 23*b*. Formed within end panel portions 23*a* and 23*b* are slide switch apertures 20 and 21 respectively. As can be seen, slide switch aperture 20 is constructed wider than slide switch aperture 21, the purpose of which is to retain slide switch 25 therewithin as will become apparent.

Figure 7:
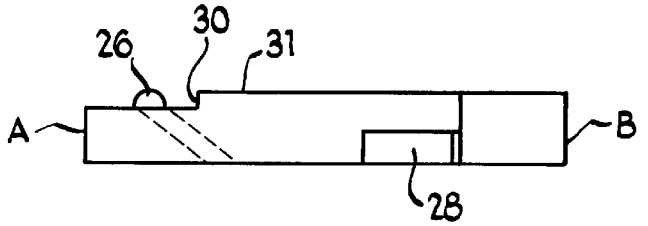
FIG. 7 of the drawings is a side elevational view of the slide switch of the present invention.
Figure 8:
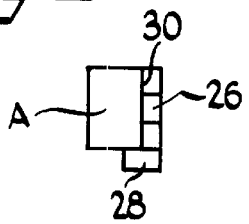
FIGS. 8 and 9 of the drawings are right and left side elevational views of the slide witch of the present invention, respectively.
Figure 9:
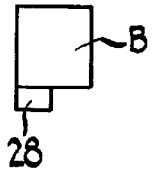

FIGS. 5 through 9 of the drawings illustrate the details of the construction of slide switch 25. Slide switch 25 comprises a substantially elongated rectangular member having formed therein magnet pocket 29*a* which serves to retain therein magnet 29. Further formed into the top of slide switch 25 is arm 27 having at its free end cam 26 which as shown in FIG. 7 has a substantially rounded profile. Flexible stop tab 28 is shown in its normal biased open position. As seen in FIGS. 7, 8 and 9, the left most end A of slide switch 25 is constructed so as to have a narrower width than the opposing end B with the transition between the thinner side A and thicker side B, evidenced by face 30, of slide switch 25 being defined by shoulder 30. Slide switch 25 is preferably constructed of a flexible plastic material which may be injection molded or formed by other known and accepted manufacturing techniques.

Figure 10:
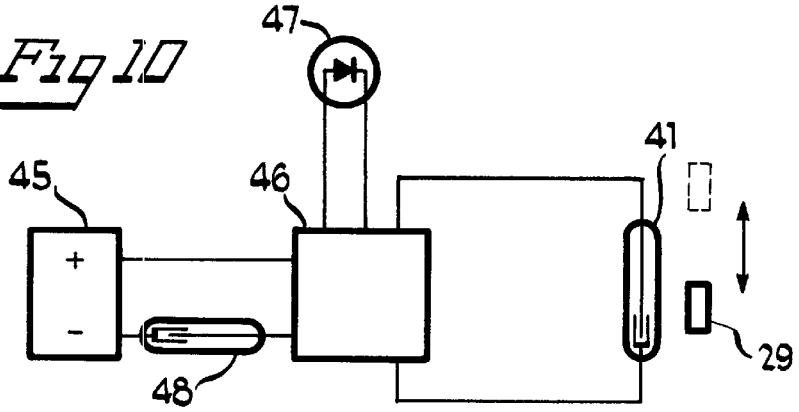
FIG. 10 of the drawings is a schematic block diagram of the light unit incorporating the present barricade light control switch apparatus.

FIG. 10 of the drawings is a schematic block diagram of the light unit incorporating the present barricade light control switch apparatus. Battery 45 is connected to printed circuit board upon which is mounted the necessary circuitry 46 for controlling operation of the light unit and in turn is connected to light source 47, shown comprising an LED. Reed switch 41 (in the present embodiment a model 3310706 MDCG-4 12-33 by Hamlin, Inc. of Lake Mills, Wis.) preferably mounted to the printed circuit board, is controlled by magnet 29 (an Alnico magnet measuring 0.125"×0.125"×0.5" by HS & S of Burle, Nebr.) which is positionable in either of the two positions illustrated. Reed switch 41 which is connected to circuitry carried on circuit board 40 is used in the preferred embodiment of the invention to select operation of the light unit as between a flashing mode or steady burn mode. Reed switch 41 may also be used to otherwise control operation of the lighting unit as would be known by those skilled in the art. A second reed switch 48 operating as switch 41 is shown connected between battery 45 and circuit 46. The operation of reed switch thus serves to control the flow of electrical energy to the light source 47 to enable or disable operation of light source 47.

Figure 11:
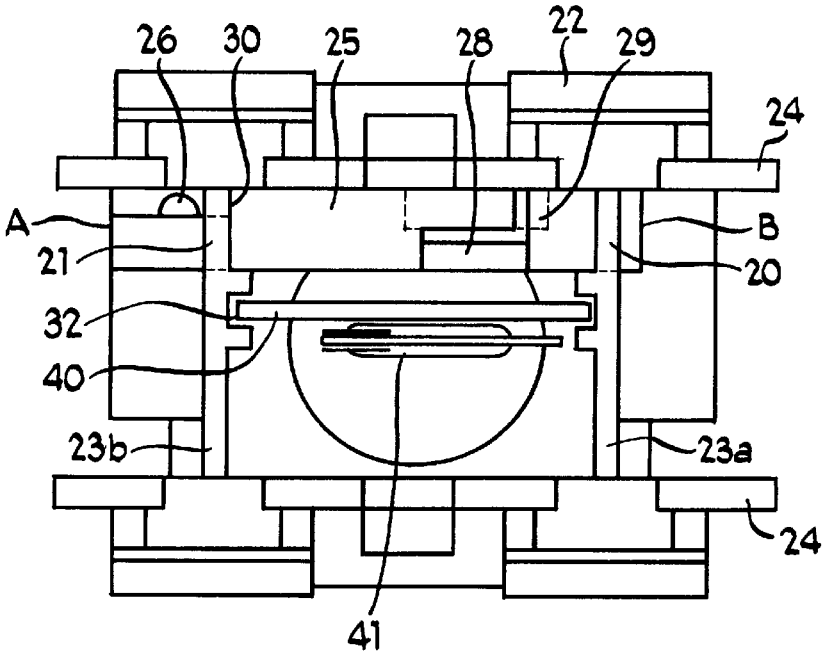
FIG. 11 of the drawings is a bottom view of the present barricade light control switch apparatus specifically showing the slide switch in a first position.

FIG. 11 of the drawings is a bottom view of candle 14 showing the assembly and operation of the present barricade light control switch apparatus. Opposing end panels 23*a* and 23*b* are shown as containing slide switch apertures 20 and 21, through which travel and between which is retained slide switch 25. During assembly of the present barricade light control switch apparatus end A of slide switch 25 is inserted through aperture 20 and then through aperture 22 whereby flexible stop tab 28 will depress into recess 28*a* upon passage through aperture 20 to permit substantially complete insertion of slide switch 25 therethrough. Given its normal biased open position, once flexible tab 28 has cleared aperture 20 it will spring back to its normally opened position and preclude movement of slide switch 25 back through aperture 20. As can be seen, given the respective dimensions of apertures of 20 and 21 and cross sectional dimensions of sides A and B of slide switch 25, the assembly of slide switch 25 into candle 14 can be accomplished in only one manner. FIG. 11 of the drawings specifically illustrates slide switch 25 in a "switch closed" position. As can be seen, in its fully closed position, shoulder 30 will abut the inside edge of end panel 23*b* thereby preventing further movement of slide switch 25 to the left. In such orientation, it can be seen that magnet 29 is brought into proximity reed switch 41 such that the magnetic field emanating from magnet 29 will activate reed switch 41. As illustrated, reed switch 41 is mounted to and carried on circuit board 40 which is itself retained within grooves 32 formed on the interior surfaces of opposing end panels 23*a* and 23*b*.

Figure 12:
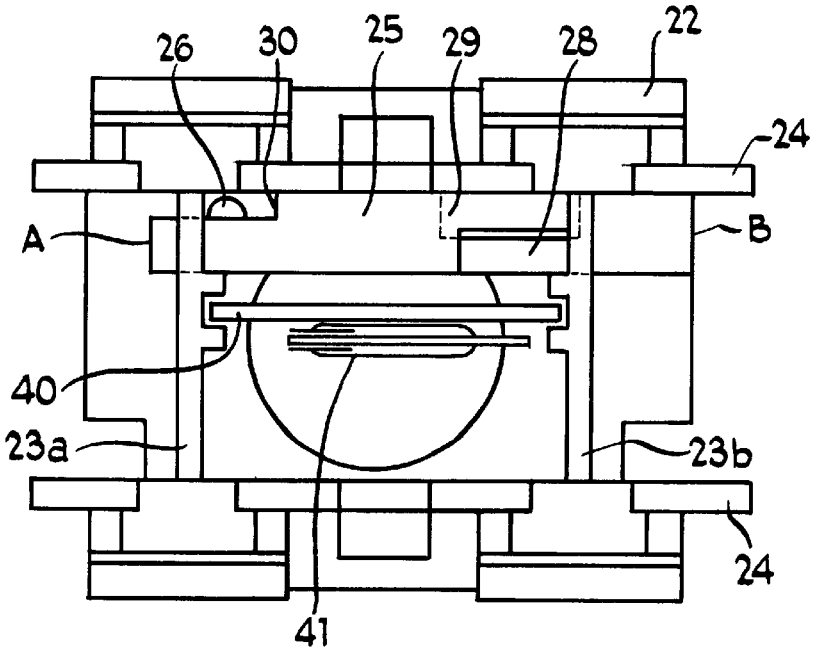
FIG. 12 of the drawings is a bottom view of the present barricade light control switch apparat specifically showing the slide switch in a second position.

FIG. 12 of the drawings illustrates slide switch 25 in a "open" position. As can be seen, slide switch 25 is positioned substantially to the right whereby flexible stop tab 28 abuts interior surface of end panel 23*a*, thereby precluding further travel of slide switch 25 to the right. As can be seen, once assembled, slide switch 25 is substantially retained within and between end panels 23a and 23*b*. In its open position, it can be seen that magnet 29 is positioned away from reed switch 41 such that magnetic field emanating from magnet 29 serves to assist reed switch 41 to return to its open position.

It can be seen that the present barricade light control switch apparatus is constructed such that magnet 29 may be and is preferably maintained in proximity to reed switch 41 during the entirety of such time as it is desired and intended that reed switch 41 be "closed". While it is known in the prior art to use and incorporate reed switches which may be activated by a magnet which is merely passed by the reed switch and which is not maintained in proximity thereof, it is intended in the present invention that magnet 29 be maintained in proximity to reed switch 41 to insure that external vibrations generated by passing vehicles do not in turn vibrate reed switch 41 overcoming any internal magnetic properties causing the reed switch to inadvertently and undesireably open. Accordingly, maintaining magnet 29 in proximity to reed switch 41 precludes undesired and inadvertent operation of the switch.

It is further observed that external vibrations caused by passing vehicles could potentially sufficiently vibrate slide switch 25 so as to cause it to travel between its two respective stop positions and thereby unintentionally operate reed switch 41. Accordingly, cam 26 emanating from arm 27 is provided. It can be seen that cam 26 can deflect from its normally raised position to permit passage of end A of slide switch 25 through aperture 21. In a normally closed position with slide switch 25 positioned with shoulder 30 abutting end panel 23*b*, cam 26 will be positioned substantially abutting the exterior surface of end panel 23*b* thereby serving to retain slide switch 25 in its then present position. Upon application of an external force sliding switch 25 to the right, cam 26 will deflect downwardly carried by arm 27 as it passes through aperture 21. As shown in FIG. 12, in the normally open position slide switch 25 is positioned such that stop tab 28 abuts the interior surface of end panel 23*a*. Cam 26 will substantially abut the interior surface of end panel 23*b*. In this manner, external vibrations are precluded from affecting the position of slide switch 25.

Movement of slide switch 25, contained wholly within housing 11, is accomplished by inserting a pin or other narrow tool 60 through access ports 16 which are configured in substantial alignment with aperture ports 20 and 21 of candle 14. In this manner a tool so inserted by press upon slide switch 25 to move it from one position to the other using through access ports 16 formed into opposing sides of housing 11. Access port 16 of course preferably of minimum size to preclude entry of dust, dirt and moisture and yet are large enough to permit insertion of a tool of sufficient strength to manipulate slide switch 25.

It is further contemplated and deemed withing the scope of the present invention to provide a light unit/barricade device wherein the battery, circuitry and reed switch are separated from the lens and light source and are postioned at the base of the barricade.

The foregoing description and drawings merely explain and illustrate the invention, and the invention is not limited thereto except in so far as the appended claims are so limited, as those skilled in the art who have the disclosure before them will be able to modifications and variations therein without departing from the scope of the invention.

What is claimed is:

1. A barricade light control switch apparatus for operating a battery powered barricade light unit, comprising:

a light unit housing;

a light source;

a battery electrically connected to said light source for supplying electrical energy to operate said light source;

circuit means for controlling operation of said light source;

said circuit means further including a reed switch, said reed switch having an open position and a closed position;

a pin member operably emanating from said light unit housing in its circuit adjustment position and removable therefrom to render said circuit unadjustable; and a magnet which when positioned in proximity to said reed switch will operate said reed switch, said magnet operably attached to said pin member in its circuit adjustment position and removed therefrom when in its unadjustable position; said magnet being movable between at least first and second positions in proximity to said reed switch by manipulation of said pin member, where when in said first position said reed switch is substantially maintained by said magnet in said closed position and when in said second position said reed switch is in said open position.

2. The apparatus according to claim 1 wherein the barricade light control switch apparatus further includes:

a magnet carrier for retaining said magnet.

3. The apparatus according to claim 2 wherein said light unit housing of said barricade light control switch apparatus further includes an aperture formed therein for permitting said removable pin member to gain access to said magnet carrier to, in turn, permit moving said magnet alternatively between at least said first position and said second position.

4. The apparatus according to claim 2 wherein the barricade light control switch apparatus further includes:

retention means operably associated with said magnet carrier for precluding unintended movement of said magnet carrier within said light unit housing, to in turn, maintain said magnet in either of said first position or said second position relative to said reed switch.

5. A barricade mounted light unit incorporating a weather resistant switch mechanism for activating the light unit, comprising:

a light unit housing;

a light source;

a battery electrically connected to said light source for supplying electrical energy to operate said light source;

circuit means for selectively causing said light source to remain substantially continually illuminated or causing said light source to be periodically illuminated in a flashing mode;

said circuit means further including a reed switch connected between said light source and said battery, said reed switch having an open position and a closed position and a pin member operably emanating from said light unit housing in its circuit adjustment position and removable therefrom to render said circuit unadjustable; and a magnet which when placed in proximity to said reed switch will operate said reed switch, said magnet operably attached to said pin member in its circuit adjustment position and removed therefrom when in its unadjustable position; said magnet being movable between at least first and second positions in proximity to said reed switch by manipulation of said pin member, where when in said first position said reed switch is substantially maintained by said magnet in said closed position such that said circuit means will cause said light source to remain substantially continually illuminated and when in said second position will open said reed switch such that said circuit means will cause said light source to be illuminated in a flashing mode.

6. The apparatus according to claim 5 wherein the barricade mounted light unit further includes:

a magnet carrier for retaining said magnet; and control means for moving said magnet carrier alternatively between said first position and said second position.

7. The apparatus according to claim 6 wherein the barricade mounted light unit further includes:

retention means for maintaining said magnet carrier in an intended position and in turn preventing unintended movement of said magnet carrier as may be induced by external vibration and forces which might otherwise serve to cause movement of said magnet carrier from its intended position.

8. A method for controlling a barricade mounted light unit which light unit includes a light source, a battery for supplying electrical energy to the light source, a reed switch for controlling operation of said light source, and a magnet for actuating said reed switch, said method comprising the steps of:

attaching a pin member to said magnet toward positioning said magnet relative to said reed switch;

positioning said magnet in a first position relative to said reed switch closing said reed switch thereby permitting operation of said light unit in a first mode;

removing said pin member from said magnet toward maintaining said magnet in said first position for such period of time as it is desired that said light unit operate in said first mode, whereby said magnet serves to maintain said reed switch in a closed position in the presence of external vibration and forces which might otherwise serve to open said reed switch;

alternatively attaching said pin member toward positioning said magnet in a second position relative to said reed switch and removing said pin member from said magnet thereby permitting operation of said light unit in a second mode.

9. A method for controlling a barricade mounted light unit which light unit includes a light source, a battery for supplying electrical energy to the light source, a reed switch for conducting electrical energy from said battery to said light source, and a magnet for actuating said reed switch, said method comprising the steps of:

attaching a pin member to said magnet toward positioning said magnet relative to said reed switch;

positioning said magnet in a first position relative to said reed switch to close said reed switch to thereby permit the connection of said battery to said light source to in turn permit operation of said light unit;

removing said pin member from said magnet toward maintaining said magnet in said first position for such period of time as it is desired that said light unit be operable, such that said magnet serves to maintain said reed switch closed in the presence of external vibration and forces which might otherwise serve to open said reed switch and render said light unit inoperable;

alternatively attaching said pin member to said magnet toward positioning said magnet in a second position relative to said reed switch to open said reed switch and removing said pin member to thereby disconnect said battery from said light source to in turn preclude operation of said light unit.

* * * * *

UNITED STATES PATENT AND TRADEMARK OFFICE

CERTIFICATE OF CORRECTION

PATENT NO. : 5,869,934
DATED : February 9, 1999
INVENTOR(S) : Goff

It is certified that error appears in the above-identified patent and that said Letters Patent is hereby corrected as shown below:

Column 4,
Line 4, delete "witch" and insert -- switch --
Line 14, delete "apparat" and insert -- apparatus --

Column 5,
Line 4, delete "as" and insert -- is --
Line 23, delete "Wis." and insert -- Wisconsin --
Line 25, delete "Nebr." and insert -- Nebraska --

Signed and Sealed this

Second Day of April, 2002

*Attest:*

*Attesting Officer*

JAMES E. ROGAN
*Director of the United States Patent and Trademark Office*